United States Patent [19]

Sedlak et al.

[11] Patent Number: 4,590,858

[45] Date of Patent: May 27, 1986

[54] MECHANISM FOR THE CONTROL OF THE INKER UNIT ON ACCESSORY DEVICES OF PRINTING MACHINES

[75] Inventors: Vaclav Sedlak, Jedovnice; Josef Jurny, Blansko; Vaclav Luner, Habruvka, all of Czechoslovakia

[73] Assignee: ZVS Adamovske strojirny, koncernovy podnik, Adamov, Czechoslovakia

[21] Appl. No.: 678,654

[22] Filed: Dec. 6, 1984

[30] Foreign Application Priority Data

Dec. 6, 1983 [CS] Czechoslovakia ..... 9094-83

[51] Int. Cl.[4] ..... B41F 31/34; B41L 27/36

[52] U.S. Cl. ..... 101/352; 101/76

[58] Field of Search ..... 101/351, 352, 148, 247, 101/349, 350, 206–209, 139, 140, 76, 77

[56] References Cited

U.S. PATENT DOCUMENTS 2,333,962 11/1943 Terry ..... 101/351

4,231,292 11/1980 Stolle ..... 101/352 X

*Primary Examiner*—J. Reed Fisher

[57] ABSTRACT

Mechanism for the control of an inker unit, particularly on an accessory device for the numbering of sheets, for additional printing, and for the perforation of sheets on a printing machine. The mechanism provides an automatic control of the inker unit as well as a manual control thereof, and provides for the disengagement of the inker unit out of the working position in such a way as to form a convenient working space in the area around the numbering roller. On an eccentric shaft, which is arranged in the side walls of the printing machine, there are attached connecting levers which are slidably arranged on a carrier shaft which is provided with carriers which are rigidly connected with guides. On the guides there is adjustably arranged an accessory device including an inker unit, there being provided openings in the connecting levers in which are arranged slide elements which are located on pivots which are fixed in the side walls of the printing machine. The mechanism of the invention makes possible an automatic control of the inker unit in dependence upon the function of the printing machine. On the one hand this reduces the need of making a number of proof prints, and on the other hand requires a much smaller space for the operation of the printing machine and its accessory device.

6 Claims, 4 Drawing Figures

MECHANISM FOR THE CONTROL OF THE INKER UNIT ON ACCESSORY DEVICES OF PRINTING MACHINES

The present invention relates to a mechanism for the control of the inker unit, particularly on an accessory device of a printing machine, the accessory device being designed for the numbering of sheets, for additional printing, and for perforation of the sheets.

The invention has among its objects the provision of an automatic control for the inker unit of the accessory device, such control also being capable of manual operation, the control being so constructed and arranged as to enable the inker to be put out of action in such a position that there will be provided a convenient working space about the numbering roller.

There are known simple accessory devices on printing machines which are designed for the numbering of sheets, for additional printing, and for the perforation of the sheets, in which the control of the inker unit, which is employed for transferring ink to the numbering elements or to the main printing cylinder, is carried out by hand.

The disadvantages of such known simple accessory devices is that the manual control of the inker unit does not provide for the necessary sequence between the functions of the basic printing machine and the accessory device. This results in a condition wherein it is necessary to print a larger number of trial impressions at the beginning of the printing operation or upon each interruption of the printing. This is particularly disadvantageous when the printed number must be in an accurate sequence even though there occurs an interruption of the printing operation. The manual control increases the burdens placed upon the operator of the printing machine.

There are also known more complicated accessory devices which usually form an independent printing unit, and which have an automatic control of such printing unit. The inker unit is located on the side walls of the accessory device, and there is provided means for applying the inking rollers of the inker unit to the numbering roller, and for removing such pressure contact of the inking rollers with the numbering roller.

A disadvantage of such latter known devices is that in consequence of the stable position of the inker unit on the side walls of the printing machine accessibility to the numbering roller becomes worse. An easy accessibility to the numbering roller is an important requirement, because the numbering elements are attached to the numbering rollers as well as pressing-on elements, the rolls, the elements for the changing of the numbers in the numbering devices, the sheet perforating cutters, and other elements which may be necessary according to the kind of work which is to be carried out.

The above outlined disadvantages of the prior art are avoided by the mechanism according to the invention. In such mechanism there is provided an eccentric shaft which is arranged in the side walls of the printing machine; on such eccentric shaft there are attached connecting levers which are slidably arranged on a carrier shaft which is provided with carriers which are rigidly connected with guides on which there is reciprocally mounted an inker unit. In the connecting levers there are provided openings in which there are located slide pieces which are arranged on pivots which are fixed in the side walls of the printing machine, and where, in the guides, there are fastened limit pins. In the carriers there is arranged a control shaft which is provided with eccentrics which are located in the openings of the connecting levers; on one end of the control shaft there is attached a lever which is provided with a roll which cooperates with a mechanism (not shown) for the supply of ink to the rollers of the inker unit and on the other end of the control shaft there is fastened a clamp which is connected with a yoke which provided with positioning pawl which engages into a cut-out which is provided in a positioning lever slidably arranged on the control shaft, the positioning lever being connected by means of a connecting pivot and a pull rod with a device (not shown) for the automatic control of the inker unit.

In the carriers there is arranged a control rod which is provided with clamps and with pins, on which there are arranged rolls which seat on upper surfaces of locks which are attached on pivots fixed in carriers. On the locks there are hingedly attached one end of coil tension springs, the other end of such springs being attached on pivots which are fixed in the carriers. On the carriers there are fastened front stops, on which there are seated front stop elements which are fastened in the side walls of the inker unit.

The advantage of the mechanism according to the present invention is that it provides an automatic control of the inker unit independence upon the function of the printing machine. This, on the one hand, reduces the need of making a number of assay prints, and on the other hand imposes smaller operating burdens upon the operator of the device. A further advantage is the simple putting out of action of the whole inker unit. By this there is provided an easier access to the numbering roller, so that numbering elements and the pressure rolls may be easily attached thereto. A further advantage is the simpler construction of the whole mechanism.

A preferred embodiment of the mechanism according to the invention is illustrated in the accompanying drawings, wherein.

Figure 1:
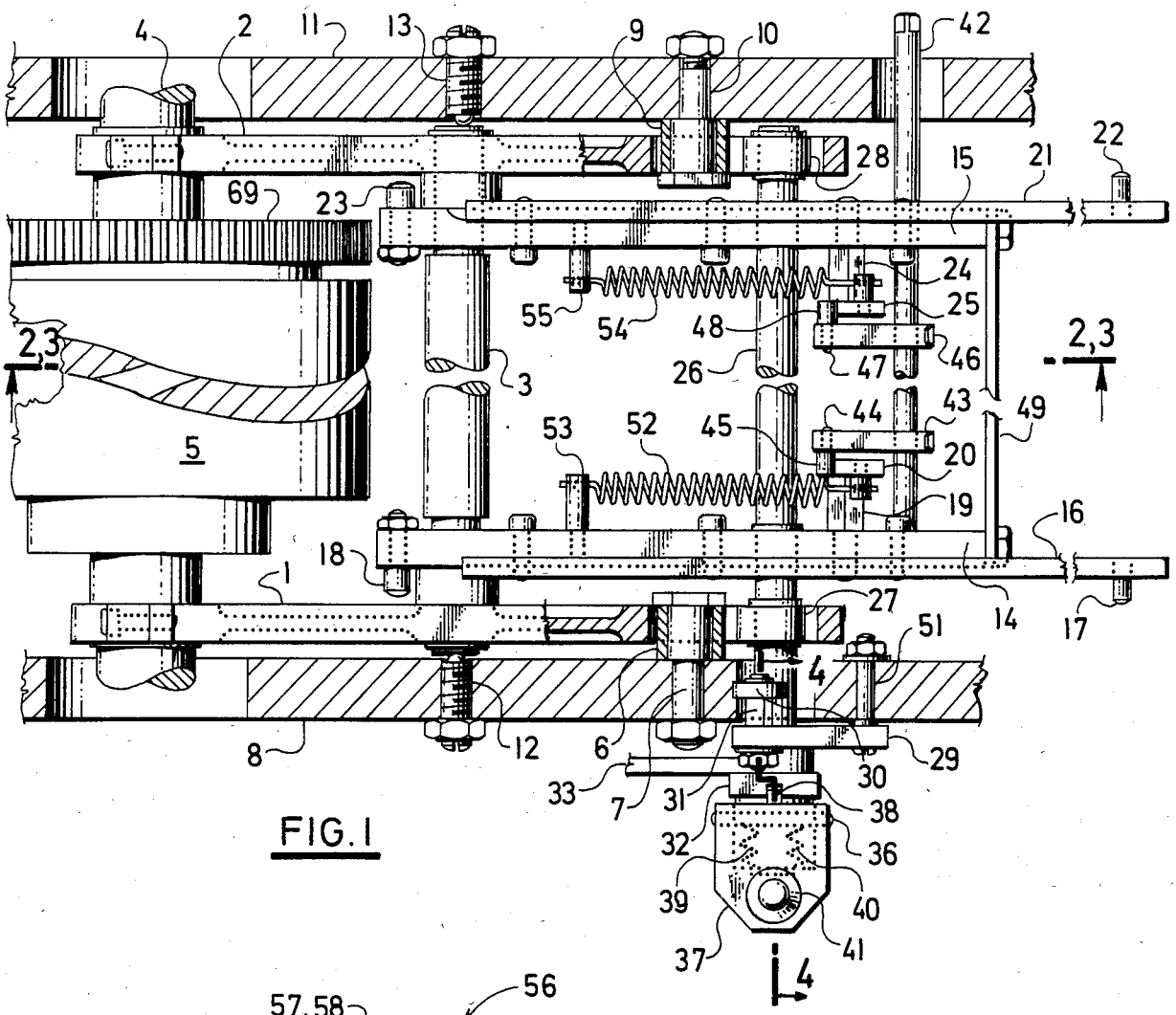
FIG. 1 is a plan view for the control of the inker unit, the parts being shown in their working positions.

Turing first to FIG. 1, there are shown parts of parallel side walls 8, 11, of a printing machine. A transverse carrier shaft 3 is journaled between a first set screw 12 threaded into the side wall 8 of the printing and a second set screw 13 threaded into the side wall 11 of the printing machine. The set screws 12 and 13 maintain the shaft 3 from appreciable axial movement. A first connecting lever 1 and a second connecting lever 2 are rotatably aranged on the carrier shaft 3 at respective opposite ends thereof. The first connecting lever 1 at its forward (left) and made in the form of a divided bearing, such bearing being mounted upon an eccentric shaft 4. The second end of the connecting lever 1 has an opening therein in which there is located a first slide piece 6 which is attached on a first pivot pin 7 which is fixed in the first side wall 8 of the printing machine.

The second connecting lever 2, on the opposite side of the printing machine, is also provided with a two-part head forming a bearing which is mounted on the second end of the eccentric shaft 4. The second connecting lever 2 is provided with an elongated opening in which there is slidably arranged a second slide piece 9 which is attached to a second pivot pin 10 affixed in the second side wall 11 of the printing machine.

On the carrier shaft 3 there is attached a first elongated carrier member 14 and second elongated carrier member 15, such two carrier members being parallel as shown most clearly in FIG. 1. The first carrier member 14 is rigidly connected with an elongated guide 16 which is provided adjacent its rear (right) end with a limit pin 17. On the first carrier 14 there is provided a front stop 18 and near the rear end thereof a pivot pin 19, a lock 20 is rotatably mounted upon the pivot pin 19. Similarly, on the other side of the mechanism there is the second carrier member 15 which is rigidly connected with an elongated guide 21, which is parallel with guide 16, and on which there is provided a rear limit pin 22. On the carrier member 15 there is affixed a front stop 23 and, adjacent to the rear end thereof, a pivot pin 24, on which there is rotatably arranged a lock 25. A control shaft 26 is rotatably mounted at its opposite ends in the respective first and second carrier members 14, 15; on the control 26 there is mounted an eccentric 27 which is slidably arranged in the elongated opening in the rear end of the first connecting lever 2.

Figure 4:
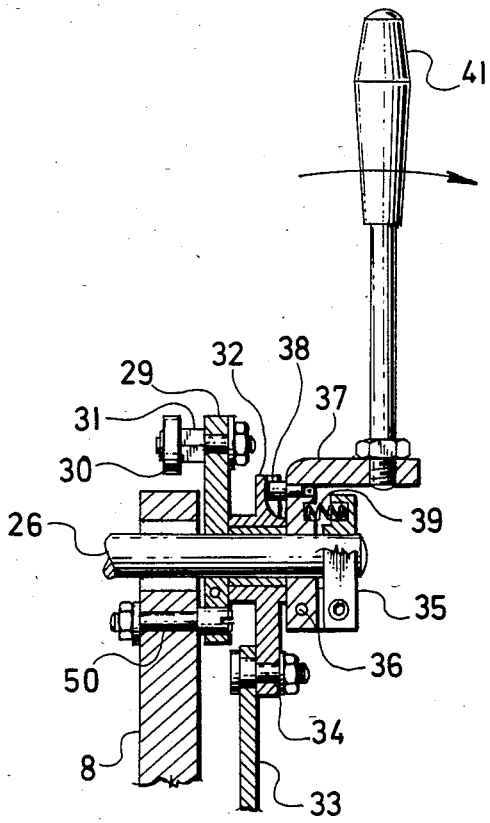
FIG. 4 is a fragmentary view in vertical section taken along the line 4—4 in FIG. 1, FIG. 4 illustrating the parts of the mechanism which makes possible its being manually controlled.

On one end of the control shaft 26 (the lower end in FIG. 1) there is attached a lever 29 which is provided with a roll 30 mounted upon a carrier pivot 31. There is further rotatably mounted upon the control shaft 26 at the lower (FIG. 1) end thereof a positioning lever 32 which is connected by means of a connecting pivot pin 34 (FIG. 4) with a pull rod 33. On end of the control lever 26 there is further fixed a clamp 35 (FIG. 4) which is provided with a pivot pin 36. On pin 36 there is swingably arranged a yoke 37 which is provided with a positioning pawl 38. The positioning pawl 38 is pressed by means of coil compression springs 39, 40 into the cut-out form in the positioning lever 32.

The yoke 37 is rigidly connected with a lever 41 adapted for the manual control of the mechanism. In the first carrier 14 and the second carrier 15 there is arranged a control rod 42 (FIGS. 2 and 3) which is provided with a first clamp 43 and with a second clamp 46, such two clamps being spaced from each other along the length of the control rod 42, as shown in FIG. 1. The first clamp 43 is provided with a pin 44, in which there is rotatably arranged a roll 45, and the second clamp 46 is provided with a pin 47, on which there is rotatably arranged a roll 48. The carriers 14, 15 are connected with a transverse rigidifying or bracing element 49 at their rear ends. The terminal outer positions of lever 29 are defined by means of adjustable eccentric pivots 50 and 51 which are fastened in the first side wall 8 of the printing machine. One end of a tension spring 52 is attached to lock 20, the other end of spring 52 being attached to a pivot 53 which is fixed on the first carrier 14. One end of a coil tension spring 54 is attached to lock 25, the other end of spring 54 being attached to a pivot pin 55 which is fixed to the second carrier 15 .

The inker unit 56 of the accessory device forms a independent unit with its own side walls 57, 58. On the first side wall 57 of the inker unit there is attached by means of a pivot a front guide roll 59. On the second side wall 58 of the inker unit 56 there is attached by means of a pivot a front guide roll 60. In the side walls 57, 58 of the inker unit 56 there is arranged a shaft 63, on which there are arranged rear guide rolls 61, 62. On the first side wall 57 of the inker unit 56 there is fastened a front stop element 64 and a rear stop element 66. On the second side wall 58 of the inker unit 56 there is fastened a stop front element 65 and rear stop element 67. The driver of the inker unit 56 when the inker is in its operative position (FIGS. 1 and and 2) is carried out by a gear 68 (FIG. 2) which is then in mesh with a gear 69 which is rigidly connected with the shaft 4 upon which the numbering roller 5 is rigidly mounted. When the inker unit is in its inoperative position (FIG. 3) gear 68 is separated from gear 69.

Figure 2:
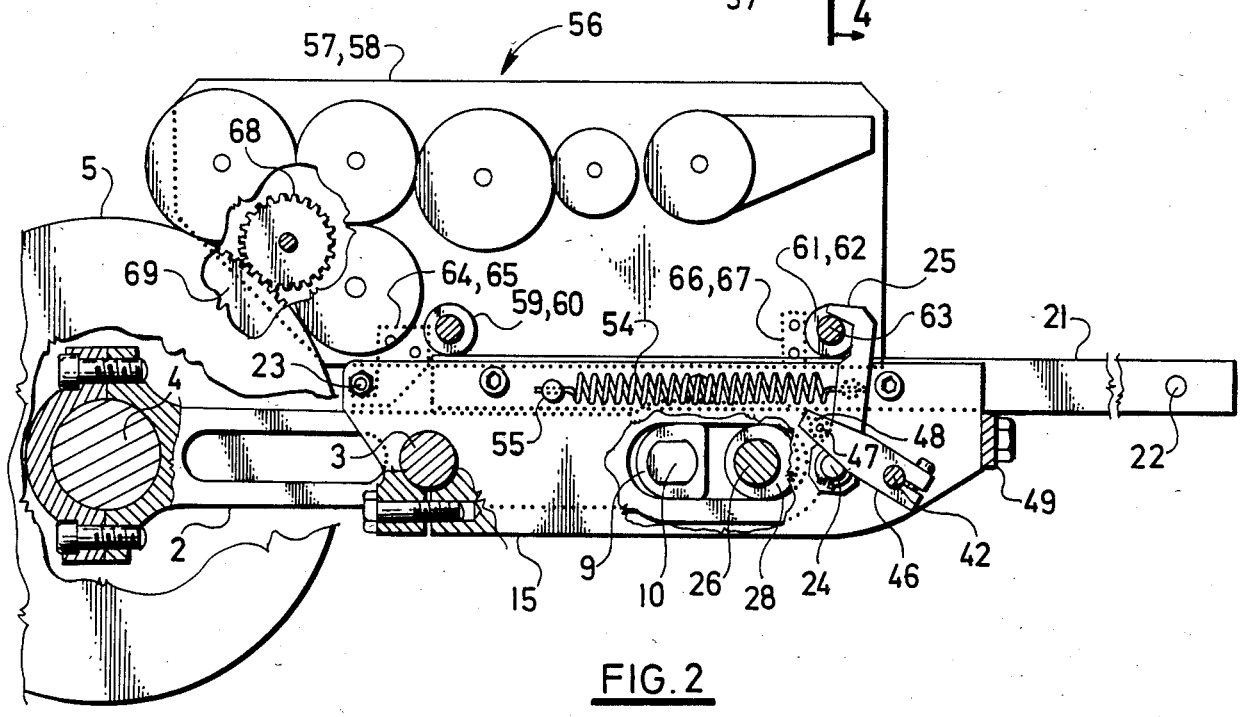
FIG. 2 is a view in vertical section of the mechanism with the parts thereof in working position, the section being taken along the broken line 2,3—2,3 in FIG. 1.
Figure 3:
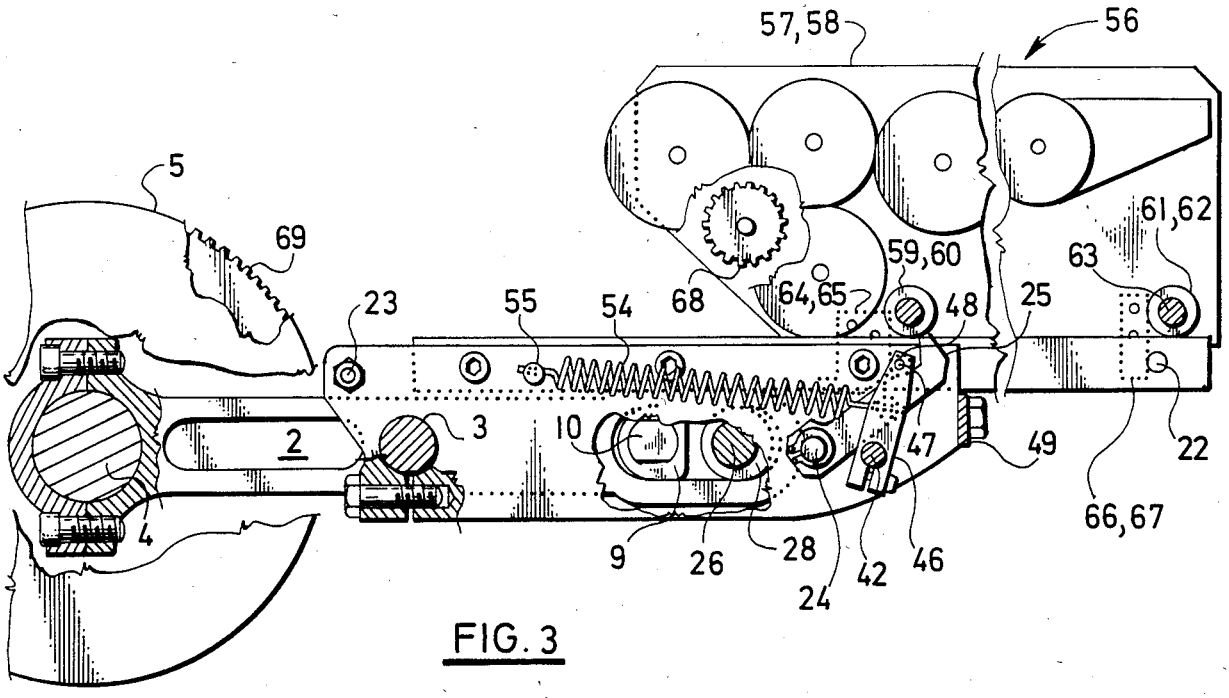
FIG. 3 is a view in vertical section taken along the broken section line 2,3—2,3 of FIG. 1, the parts of the mechanism being shown in their not-working or inoperative positions.

The above described mechanism operates as follows:

The inker unit 56 is arranged by means of the front guide rolls 59, 60 and rear guide rolls 61, 62 on guides 16, 21 which are fixed on carrier members 14, 15. By means of coil tension springs 52, 54, the locks 20, 25 are pressed on the shaft 63 and the inker 56 seats by means of the front stop elements 64, 65 on the front stops 18, 23. The described position of the inker unit 56 is a functional position, in which the driver gear 68 is in mesh with the gear 69 which is fixed connected to the numbering roller 5. FIGS. 1 and 2 show such operative or working position of the mechanism.

By the movement of the pull rod 33, which is derived from a control mechanism (not shown), the control shaft 26 is turned by means of the positioning lever 32, the positioning pawl 38, the yoke 37, and the clamp 35. The control shaft 26 further turns the connecting levers 1, 2 by means of the eccentrics 27, 28 which are arranged in the oval cut-outs provided in the connecting levers 1, 2. The carriers 14 and 15 with the guides 16, 21 swing around the carrier shaft 3. By this there is secured the putting of the inker unit 56 into operative engagement with numbering roller 5. The roll 30 is arranged on the lever 29, which is rigidly connected with the control shaft 26, and which gives an impulse to a device (not shown) which secures the supply of ink from the ink fountain of the printing machine to the rollers of the inker unit. By the movement to the rear or right of the pull rod 33, the inker unit 56 is moved out of operative engagement with the numbering roller 5 and the supply ink to the inker unit 56 is stopped.

The above described function of the mechanism can also be carried out manually by means of operation of the lever 41. By the movement of the lever 41 in the direction of the curved arrow in FIG. 4 so as to overcome the opposition of the coil compression springs 39, 40, the positioning pawl 38 (FIG. 4) is shifted out from the cut-out of the positioning lever 32. By the subsequent turning of the lever 29 around the axis of the control shaft 26, there is carried out the manual operative engagement of the inker unit 56 with the numbering roller 5 or the disengagement of the inker unit 56 from the numbering roller 5. Simultaneously, the supply of ink to the roller of the inker unit 56 is released or is stopped, respectively. The terminal positions of the putting into operative engagement of the inker unit 56 and the numbering roller 5, and the putting of the inker unit 56 out of effective operative engagement with the numbering roller 5 are limited, respectively, by the eccentric pivots 50 and 51.

The putting of the inker unit 56 into a position out of effective engagement with the numbering roller 5 is carried out in the following manner:

By means of a wrench, the operator manually turns the control rod 42 with the clamps 43, 46. The rolls 45 and 48 roll on the functional surface of the locks 20, 25 and effect their release, by which the inker unit 56 is released from operative engagement with the numbering roller 5. By the shifting-off of the inker unit 56 manually to the right (FIG. 3) on the guides 16 and 21, the inker unit 56 is changed over into its inoperative position. This position is limited by the engagement of the rear stop elements 66 and 67 on the limit pins 17, 22. By the reverse proceeding, the inker unit 56 is manually shifted to the left (FIGS. 1 and 2 ) into its working position wherein it is in operative engagement with the numbering roller 5.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. In combination, a printing mechanism having a frame, a driven printing roller mounted on the frame, and an inker unit of an accessory device for the printing mechanism supported on guiding members attached to the frame for selective reverse movement between the first, operative terminal position close to the printing roller and a second, inoperative terminal position, substantially spaced from the printing roller, said inker unit mounted on the accessory device for selective cooperation with the printing roller, a first gear drivingly connected to the printing roller, a second gear drivingly connected to the inker unit, the first and second gears being in meshing relationship when the inker unit of the accessory device is in its first terminal position and being out of meshing relationship when the inker unit of the accessory device is in its second terminal position, the frame of the printing mechanism including spaced parallel side walls, the driven printing roller being mounted between said side walls of the printing mechanism, the guiding members for supporting the inker unit of the accessory device being mounted upon the respective side walls of the printing mechanism, the second gear being mounted upon a drive shaft on the accessory device for the inker unit, the axis of said drive shaft being parallel to the axis of the printing roller, a transverse eccentric shaft mounted in the side walls of the printing machine, a transverse carrier shaft disposed between and mounted upon the side walls of the printing machine, spaced parallel connecting levers slidably arranged on the carrier shaft, carriers mounted upon the connecting levers, guides mounted upon the carriers, the accessory device including the inker unit being slidably mounted upon said guides, the connecting levers defining openings in which there are located slide pieces which are arranged on pivots affixed to the respective side walls of the printing machine.

2. The combination according to claim 1, comprising limiting stop means for the travel of the accessory device toward the printing roller disposed on the ends of the carriers adjacent to the printing roller, and limiting stop means for the movement of the inker unit of accessory device into its second, inoperative position, disposed on the outer ends of the guides remote from the printing roller.

3. The combination according to claim 2, wherein in the carriers there is arranged a control shaft which is provided with eccentrics arranged in the openings provided in the connecting levers, and comprising a control shaft, a lever attached to the end of the control shaft, said lever being provided with a roll which cooperates with a mechanism for the control of the supply of ink to the rollers of the inker unit, on the same end of the control shaft there being affixed a clamp which is connected with a yoke which provided with a positioning pawl which engages into a cut-out which is provided in a positioning lever which is slidably arranged on the control shaft, the positioning lever being provided by means of a connecting pivot and a pull rod with a device for the automatic control of the accessory device.

4. The combination according to claim 4, comprising a control rod arranged in the carriers, said control rod being provided with clamps and with pins on which there are arranged rollers which engage the upper surfaces of locks which are attached on pivots fixed in the carriers.

5. The combination according to claim 4, wherein coil tension springs are arranged with one end of a spring attached to a respective lock and other end of the spring attached to pivots which are fixed into the carriers.

6. The combination according to claim 5, wherein the front stops on carriers cooperate with front stops elements fixed to the side walls of the inker unit when the inker unit of the accessory device is in its first, operative terminal position.

* * * * *